United States Patent [19]

Hirano et al.

[11] Patent Number: 4,553,505

[45] Date of Patent: Nov. 19, 1985

[54] CYLINDER HEAD OF INTERNAL COMBUSTION ENGINE

[75] Inventors: Yoshinori Hirano, Yokohama; Masahiko Kondo; Takao Kubozuka, both of Yokosuka, all of Japan

[73] Assignee: Nissan Motor Co., Ltd., Yokohama, Japan

[21] Appl. No.: 624,369

[22] Filed: Jun. 25, 1984

[30] Foreign Application Priority Data

Jul. 11, 1983 [JP] Japan ..... 58-124802

[51] Int. Cl.[4] ..... F01P 3/22

[52] U.S. Cl. ..... 123/41.2; 123/41.79; 184/6.2

[58] Field of Search ..... 123/41.27, 41.2, 41.21, 123/41.82 R, 41.79, 41.15, 41.28; 184/6.2, 106

[56] References Cited

U.S. PATENT DOCUMENTS

| | | | |
|---|---|---|---|
| 1,072,946 | 9/1913 | Hesselman | 123/41.79 |
| 1,687,679 | 10/1928 | Mallory | 123/41.21 |
| 1,712,464 | 5/1929 | Woolson | 123/41.28 |
| 1,891,638 | 12/1932 | Gadoux | 123/41.79 |
| 2,030,894 | 2/1936 | Pennebaker | 123/41.79 |
| 2,077,085 | 4/1937 | Zahodiakw | 123/41.79 |
| 2,281,694 | 5/1942 | Huber | 123/41.79 |
| 2,938,601 | 5/1960 | Brafford | 184/6.2 |
| 3,757,747 | 9/1973 | Hartmann | 123/41.28 |
| 4,453,527 | 6/1984 | Wade | 123/193 P |

FOREIGN PATENT DOCUMENTS

| | | | |
|---|---|---|---|
| 311529 | 12/1928 | United Kingdom | 184/6.2 |

*Primary Examiner*—Craig R. Feinberg
*Assistant Examiner*—David A. Okonsky
*Attorney, Agent, or Firm*—Schwartz, Jeffery, Schwaab, Mack, Blumenthal & Evans

[57] ABSTRACT

An improved cylinder head of internal combustion engine cooled by a so-called boiling liquid cooling system is disclosed, which has in its coolant jacket baffle members in order to inhibit the movement of liquid coolant within the jacket due to changes in attitude of the engine.

9 Claims, 9 Drawing Figures

CYLINDER HEAD OF INTERNAL COMBUSTION ENGINE

BACKGROUND OF THE INVENTION

1. Field of the Invention

The present invention relates to an internal combustion engine which is cooled by a so-called boiling liquid cooling system, and more particularly to an improved cylinder head for such engine wherein coolant is introduced thereinto in liquid state and exhausted therefrom to a heat exchanger in a gaseous state.

2. Description of the Prior Art

Hitherto, there has been proposed a so-called boiling liquid cooling system (viz., evaporative cooling system) for cooling an internal combustion engine. This type cooling system basically features an arrangement wherein a liquid coolant (water) in the coolant jacket of the engine is permitted to boil and the gaseous coolant thus produced is passed out to an air-cooled heat exchanger or condenser where the gaseous coolant is cooled or liquefied and then recirculated back into the coolant jacket of the engine. Due to the effective heat exchange effected between the gaseous coolant in the condenser and the atmosphere surrounding the condenser, the cooling system exhibits a very high performance. European Patent Application No. 0,059,423 published on Sept. 8, 1982 discloses one of the above-mentioned cooling systems.

However, some of the prior art systems hitherto proposed have suffered from a drawback, due to their inherent construction of the cooling jacket formed in the cylinder head of the engine, in that when the attitude of the engine changes with respect the horizontal (which occurs, for example, when the vehicle is traversing a steep hill or inclines), the coolant tends to move toward a lower side of the jacket thereby to leave a heated portion of the engine uncovered and/or insufficiently covered with the coolant. This drawback will be well understood from FIGS. 2 and 4 which show respectively the undesired conditions of FR (front engine rear drive) (see FIG. 1) and FF (front engine front drive) (see FIG. 3) motor vehicles, each being equipped with the boiling liquid cooling system. The engine of FIG. 2 is of a gasoline type, while, the engine of FIG. 4 is of a diesel type.

As may be understood from the drawings, the undesired condition tends to permit a dry zone to form in the coolant jacket. This dry zone, due to the apparent lack of coolant, becomes highly heated and further promotes the "dry-out" phenomenon, so that engine knocking and/or thermal damage of the engine tends to occur. This problem becomes quite severe in case of the diesel engine because the pre-combustion chambers thereof are excessively heated during the operation thereof.

SUMMARY OF THE INVENTION

It is therefore an object of the present invention to provide an improved cylinder head which is free of the above-mentioned drawbacks.

According to the present invention, there is provided, in an internal combustion engine including a structure defining a combustion chamber, means defining about the combustion chamber a coolant jacket into which the coolant is introduced in liquid state and from which the coolant is discharged in gaseous state, means for maintaining the level of the liquid coolant in the jacket at a first level higher than the combustion chamber, a baffle member extending from the structure to a second level intermediate of the first level and the combustion chamber, the baffle member inhibiting the movement of the liquid coolant within the jacket due to changes in attitude of the engine.

BRIEF DESCRIPTION OF THE DRAWINGS

Other objects and advantages of the present invention will become apparent from the following description when taken in conjunction with the accompanying drawings, in which.

DESCRIPTION OF THE EMBODIMENTS

Prior to describing in detail the construction of the cylinder head according to the present invention, the boiling liquid cooling system to which the present invention is practically applied will be described with reference to FIG. 5.

Figure 5:
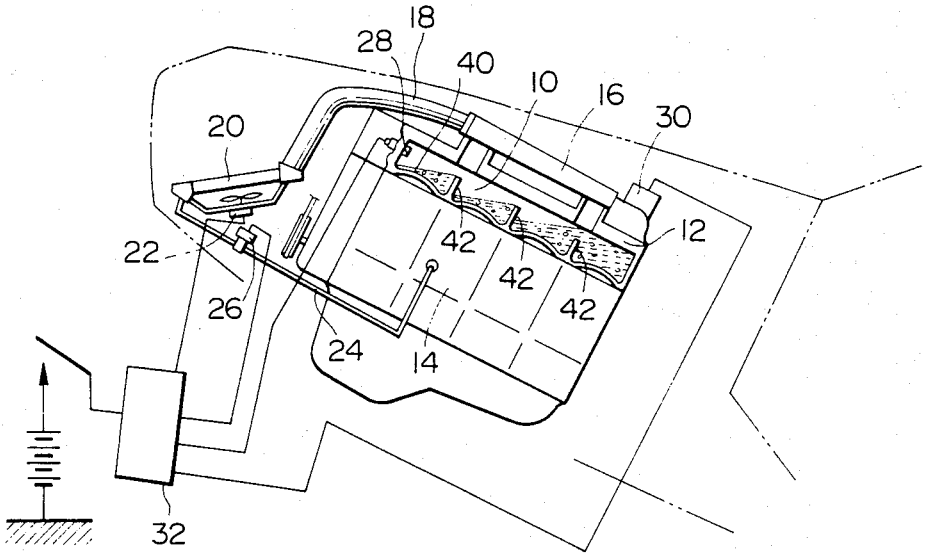
FIG. 5 is a longitudinally sectional view of an engine which is equipped with an improved cylinder head according to the present invention, the view showing a condition wherein the vehicle inclines.

As is shown in FIG. 5, the system comprises a coolant jacket 10 formed in the cylinder head 12 and another coolant jacket formed in the cylinder block 14, these coolant jackets being fluidly connected with each other. The coolant jacket 10 of the cylinder head 12 has at its upper portion a vapor chamber (10', see FIG. 6) merged therewith. A vapor manifold 16 is mounted on the cylinder head 12 and fluidly connected to the vapor chamber 10'. A relatively thick tube 18 extends from the outlet of the vapor manifold 16 to an inlet of an air-cooled heat exchanger (or condenser) 20. An electric fan 22 is positioned near the heat exchanger 20 and produces, when electrically energized, a cooling air flow which passes over the heat exchanger 20 to promote the cooling effect of the same. A relatively thin tube 24 extends from the outlet of the heat exchanger 20 to the coolant jacket of the cylinder block 14. An electric pump 26 is disposed on the thin tube 24 and pumps up the liquefied coolant in the lower portion of the heat exchanger 20 into the coolant jacket when electrically energized. A liquid level sensor 28 is mounted to the cylinder head 12 to detect the coolant level therein, and an inclination sensor 30 is mounted on the engine to detect the attitude of the engine with respect to the horizontal. A control unit 32 is employed for controlling the operations of the electric fan 22 and the electric pump 26 in accordance with the information signals issued from the coolant level sensor 28 and the inclination sensor 30.

In operation, the coolant in the coolant jacket 10 of the cylinder head 12 is permitted to boil and the gaseous coolant thus produced passes out through the vapor manifold 16 and the tube 18 to the heat exchanger 20 where the gaseous coolant is cooled and thus liquefied. During the condensation of the coolant in the heat exchanger 20, the coolant removes a large amount of heat thereby allowing the cooling system to have a high cooling efficiency. Subsequent to this condensation, the liquefied coolant is recirculated back into the coolant jacket of the cylinder block 14 by the electric pump 26.

With the provision of the control unit 32, the following operation is carried out in the system.

When the liquid coolant in the cylinder head 12 is reduced to such a degree that the probe of the level sensor 28 is raised up from the liquid coolant (viz., when the level sensor 28 detects a lack of the coolant in the coolant jacket 10), the level sensor 28 issues a signal to permit, through the control unit 32, the electric pump 26 to be energized. With this operation, normally, the coolant in the coolant jacket of the engine is kept at a predetermined amount during the operation of the engine. When, however, the engine is inclined by such a degree that the probe of the level sensor 28 raised up from the liquid coolant in such a manner as shown in FIG. 5, the energization of the electric pump 26 is suppressed due to a so-called block signal issued from the inclination sensor 30. However, when the inclination of the engine continues for a predetermined time, the suppression of energization of the electric pump 26 becomes cancelled thereby to restore energization of the pump 26. For achieving this operation, the control unit 32 may include a timer means.

Figure 9:
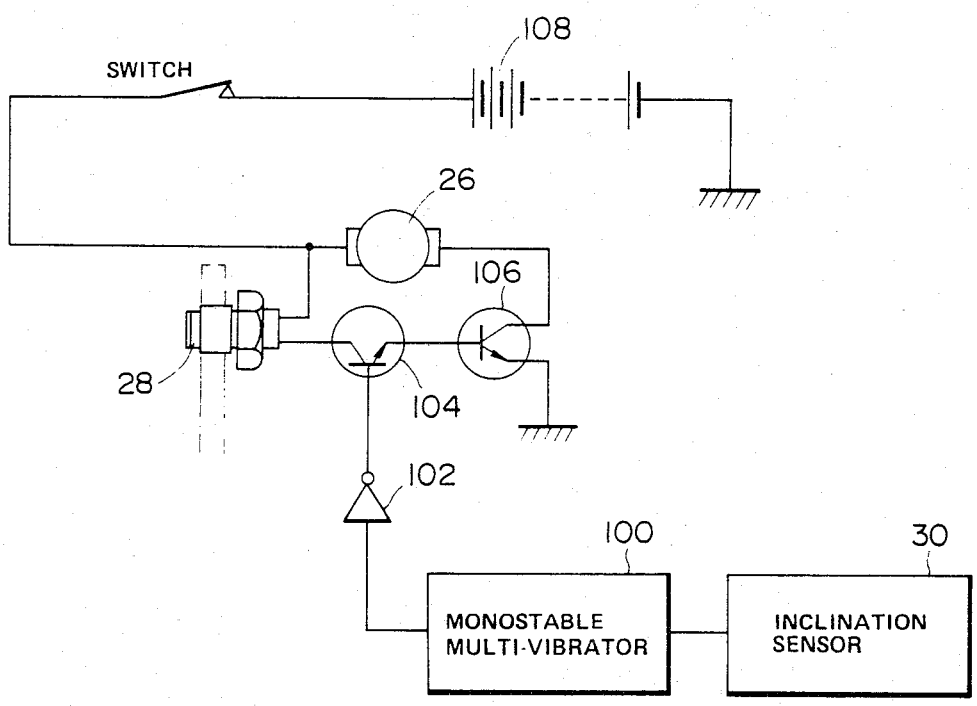
FIG. 9 is a circuitry for controlling the operation of a pump.

An example of circuitry which can be used to control the operation of the pump 26 as described above is shown in FIG. 9. The function of this circuit is such that when the vehicle is running on a level surface, the output of the inclination sensor 30 assumes a low level. The monostable multivibrator 100 is accordingly not triggered under such circumstances whereby it also outputs a low level signal. Accordingly, the inverter 102 normally outputs a high level signal to the base of the transistor 104 rendering same conductive. This of course completes a circuit between the level sensor 28, the pump 26 and the transistor 106 so that upon the level sensor 28 outputting a signal indicative that it is not immersed in the coolant, the transistor 106 is rendered conductive and the pump 26 duly energized by the electric power of the battery 108. However, upon the vehicle ascending or descending an incline, it is possible, as disclosed hereinbefore, that the coolant level falls below the level sensor 28 due to the change in attitude of the engine. Under such circumstances, the inclination sensor 30 is triggered to output a high level signal to the monostable multivibrator 100 triggering same into its quasi stable state. The monostable multivibrator 100 thus outputs a high level signal for a predetermined period of time. Accordingly, the signal applied to the base of the transistor 104 by the inverter 102 assumes a low level rendering the transistor 104 not-conductive. This of course temporarily prevents the pump 26 from pumping excess coolant into the coolant jacket 10. After the predetermined period of time has elapsed, the normal operation of the pump circuit is restored to ensure an adequate supply of coolant into the coolant jacket 10.

Figure 6:
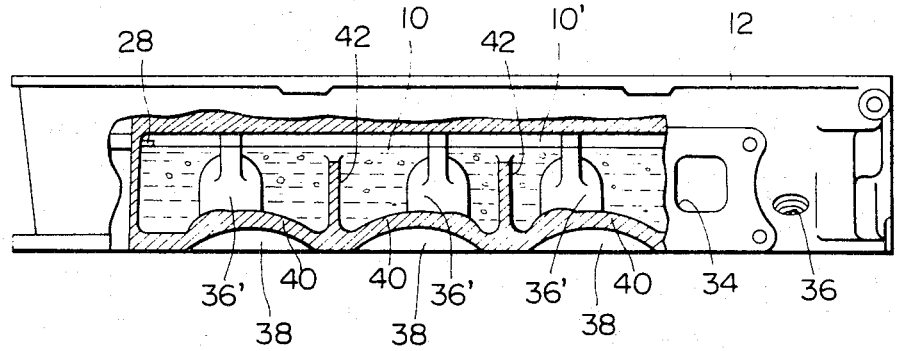
FIG. 6 is a partially sectional side view of the cylinder head employed in the engine of FIG. 5.

Referring to FIG. 6, there is shown an essential part of the cylinder head 12 employed in the engine of FIG. 5. As shown, the cylinder head 12 is formed with exhaust ports 34 (only one is shown) formed in the side thereof and bores 36 for receiving therein spark plugs. Designated by numerals 36' are inwardly swelled walls in which the spark plug receiving bores 36 are defined, respectively. The cylinder head 12 is also formed with cavities 38 which cooperate with cylinders formed in the cylinder block 14 to define variable volume combustion chambers. By the provision of the cavities 38, a plurality of inwardly swelled portions 40 are formed at the bottom of the coolant jacket 10, as shown. The coolant jacket 10 of the cylinder head 12 extends longitudinally along the alignment of the combustion chambers in proximity of the cavities 38. The inwardly swelled walls 36' for the spark plugs are also exposed to the coolant jacket 10. The coolant level sensor 28 is located at such a vertical position that under horizontal or normal standing of the engine, the coolant in the jacket 10 is maintained at a level adequate for maintaining the cylinder head structure subject to high heat flux (viz., combustion chambers, exhaust ports and valves) totally immersed.

Baffle members 42 are spacedly arranged in the coolant jacket 10 and extend transversely, that is, in a direction substantially perpendicular to the longitudinal axis of the engine, thereby to define in the coolant jacket 10 a plurality of cells or recesses. Preferably, each cell is positioned just or exactly above the corresponding combustion chamber, as will be understood from FIG. 6. Each baffle member 42 is integrally connected at its opposed ends with the respective sides of the cylinder head 12 and extends upwardly from the bottom of the coolant jacket 10 to a level intermediate of the level of the level sensor 28 and the top of the inwardly swelled portion 40. In the disclosed embodiment, each baffle member 42 is located at the intermediate portion between the neighbouring two swelled portions 40. By the reasons which will become apparent as the description proceeds, although lower than the level sensor 28, the baffle members 42 are constructed much higher than the swelled portions 40.

With the provision of the baffle members 42, the following advantageous operation is expected from the cooling system.

When, as is shown by FIG. 5, the attitude of the engine changes with respect to the horizontal due to, for example, the vehicle running on a slanted road, the attitude of the coolant surface changes. However, the provision of the baffle members 42 prevents or at least minimizes the downward movement of the liquid coolant in the coolant jacket 10. That is to say, even when the attitude of the coolant surface changes due to the vehicle running on the slanted road or under the influence of centrifugal force (produced when traversing a curve or the like), the heated portions of the cylinder head structure are kept immersed in the liquid coolant.

Thus, the afore-mentioned undesirable "dry out" phenomenon does not occur in the present invention. When the attitude of the engine is returned to the horizontal position, the coolant which has gathered at the lower-positioned cells moves back to the other cells flowing over the baffle members 42 with a result that the coolant is evenly distributed to the cells.

It is to be noted that the provision of the baffle members 42 increases the mechanical strength of the cylinder head 12 and thus suppresses vibration of the same produced under operation of the engine.

Figure 7:
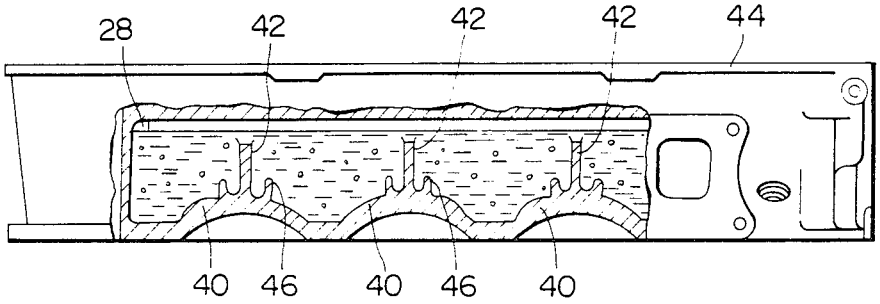
FIG. 7 is a view similar to FIG. 6, but showing a second embodiment of the present invention.

Referring to FIG. 7 of the drawings, there is shown a second embodiment of the present invention, which is a slight modification of the cylinder head 12 of the first embodiment shown in FIG. 6. In the cylinder head 44 of this second embodiment, each baffle member 42 is disposed on the top of the inwardly swelled portion 40 where the thermal load is excessively high. Two small projections 46 are arranged at either sides of each baffle member 42. With the addition of the small projections 46, the heat transmitting surface of the swelled portions 40 is increased, so that the heat transfer from the combustion chambers to the coolant in the coolant jacket 10 is considerably improved as compared with the case of the first embodiment of FIG. 6. In other words, uniformed thermal distribution in the structure of the cylinder head 44 is expected from this second embodiment.

Figure 1:
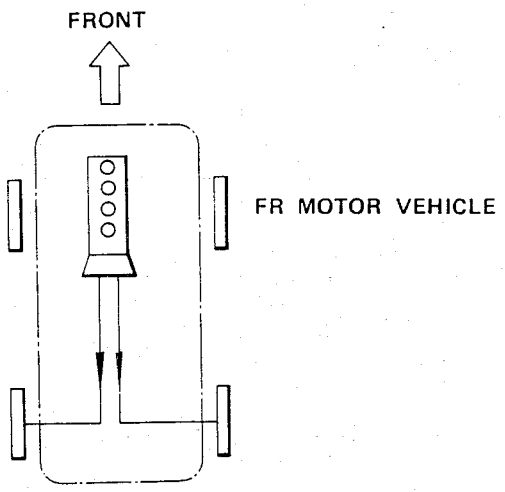
FIG.1 (PRIOR ART)
FIG. 1 is a schematic view of a so-called FR (front engine rear drive) type motor vehicle wherein the engine is mounted longitudinally on a front portion of the vehicle with the rear road wheels driven by the engine.
Figure 2:
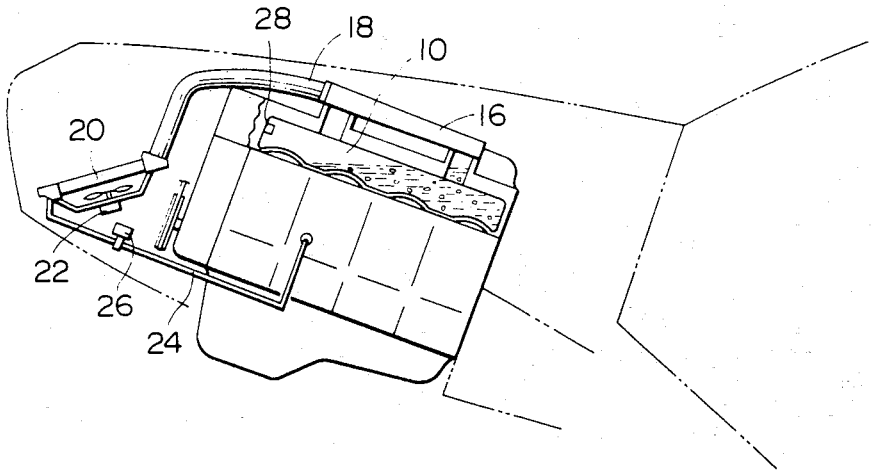
FIG.2 (PRIOR ART)
FIG. 2 is a longitudinally sectional view of the prior art gasoline engine discussed briefly in the opening paragraphs of the specification, the engine being mounted longitudinally in a manner as shown by FIG. 1.
Figure 3:
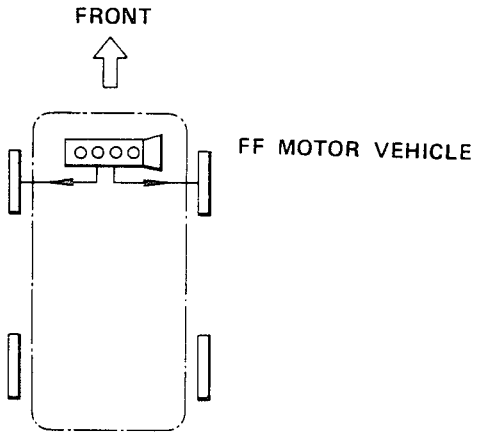
FIG. 3 is a schematic view of a so-called FF (front engine front drive) type motor vehicle wherein the engine is mounted transversely on a front portion of the vehicle with the front road wheels driven by the engine.
Figure 4:
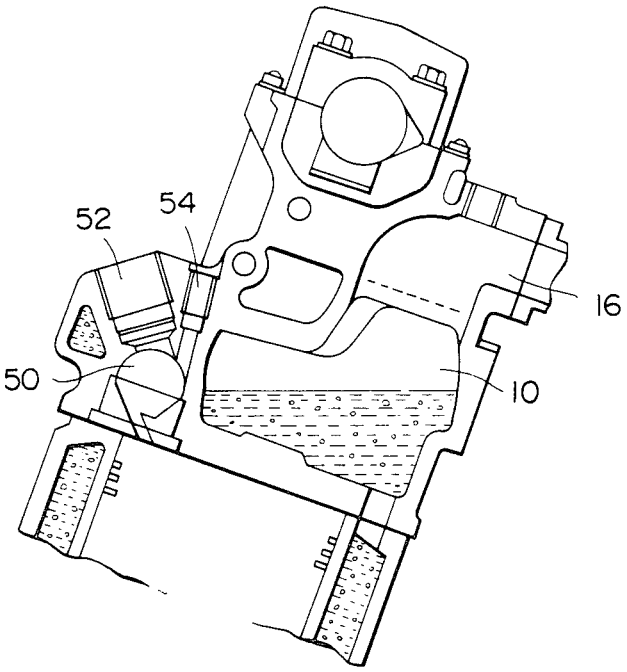
FIG.4 (PRIOR ART)
FIG. 4 is a transversely sectional view of the prior art diesel engine also discussed briefly in the opening paragraphs of the specification, the engine being mounted transversely in a manner as shown by FIG. 3.
Figure 8:
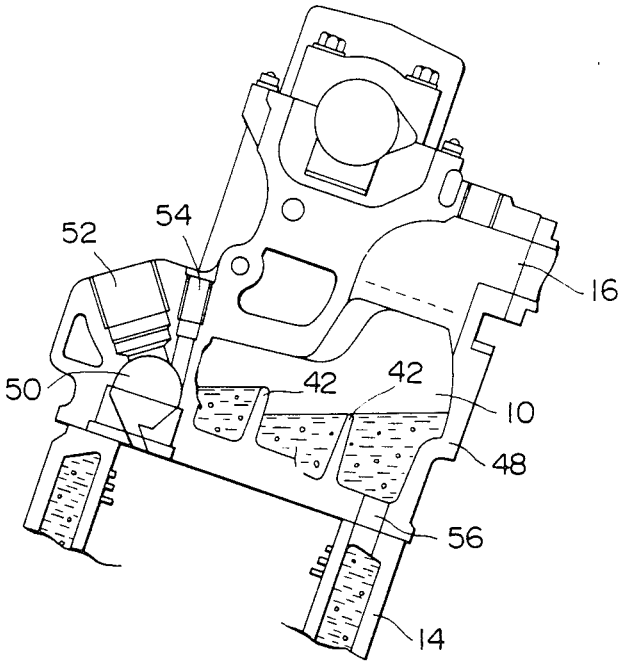
FIG. 8 is a transversely sectional view of a diesel engine to which the present invention is practically applied, the view showing a condition wherein the engine inclines about an axis substantially parallel with the longitudinal axis of the engine.

Referring to FIG. 8, there is shown a third embodiment of the present invention, which is a cylinder head 48 for a diesel engine. The engine shown is to be transversely mounted on a FF (front engine front drive) type motor vehicle (see FIG. 3).

The cylinder head 48 of this third embodiment is formed with pre-combustion chambers 50, bores 52 for receiving therein fuel injection nozzles (not shown) and bores 54 for receiving therein glow plugs (not shown). The coolant jacket 10 formed in the cylinder head 48 extends longitudinally along the alignment of the combustion chambers in proximity of the pre-combustion chambers 50. As shown, the coolant jacket 10 of the cylinder head 48 is fluidly connected to the coolant jacket of the cylinder block 14 through bores 56 which are formed in the mating decks of the cylinder head 48 and the cylinder block 14. The cylinder head 48 is integrally formed with a vapor manifold 16 which is fluidly connected to the coolant jacket 10. Although not shown in the drawing, the outlet of the vapor manifold 16 is connected to the inlet of the heat exchanger in such a manner as shown in FIG. 5. Furthermore, an electric control system such as the system employed in the first embodiment (FIG. 6) is also used in this third embodiment.

Baffle members 42 are spacedly arranged in the coolant jacket 10 and extend "longitudinally", that is, in a direction substantially parallel with the longitudinal axis of the engine, thereby to define in the coolant jacket 10 a plurality (three in the disclosed embodiment) of elongate cells or recesses. Each baffle member 42 is integrally connected at its longitudinally opposed ends with the respective longitudinal ends of the cylinder head 48, and extends upward from the bottom of the coolant jacket 10 to such a level as stated in the description of the first embodiment. However, in this case, the coolant level sensor is positioned at a level higher than the top portions of the pre-combustion chambers 50.

When, as is seen from the drawing, the attitude of the engine changes with respect to the horizontal due to, for example, the vehicle running on a slanted road, the attitude of the coolant surface changes. However, the provision of the baffle members 42 prevents or at least minimizes the downward movement of the coolant in the coolant jacket 10. Thus, the afore-mentioned undesirable "dry-out" phenomenon does not occur because of the same reasons as mentioned hereinafore.

Although, in the foregoing description, the baffle members 42 are described as a so-called "daming means" which, upon slanting of the vehicle (or engine), dams up the coolant in the coolant jacket 10, these baffle members 42 also act as a so-called "rushing flow obstructing means" which, upon rapid change of the attitude of the coolant surface, due to, for example, rapid deceleration of the vehicle, prevents undesired rushing flow of the coolant in the liquid state into the heat exchanger. Considering a remarkable drop of the cooling efficiency of the heat exchanger due to introduction of the coolant in the liquid state, the rushing flow obstructing function possessed by the baffle members is also very important.

In addition to the above-mentioned embodiments, the following modifications are also possible in the present invention.

(1) The baffle members 42 are arranged transversely and longitudinally in the coolant jacket 10 in a manner to form a grid-shaped cells or recesses therein. With this construction, the daming effect of the baffle members 42 is well exhibited when the vehicle is traversing a corner or the like. If desired, the baffle members 42 may be arranged obliquely in the coolant jacket 10.

(2) If the coolant jacket 10 of the cylinder head 12 is constructed to have an adequately large vapor chamber 10', the inclination sensor 30 may be removed from the system. This is because even when, upon slanting of the vehicle, the amount of coolant in the coolant jacket is increased, the larger chamber does not cause the undesired outflow of the coolant in the liquid state into the heat exchanger.

What is claimed is:

1. A boiling liquid cooling system for an internal combustion engine including a cylinder head having therein at least one combustion chamber, comprising:

first means defining about said combustion chamber a coolant jacket into which a coolant is introduced in a liquid state and from which the coolant is discharged in a gaseous state;

second means for condensing and thus liquifying the gaseous coolant introduced thereto from said coolant jacket;

third means for feeding to the coolant jacket coolant liquified by said second means;

fourth means for maintaining the level of the liquid coolant in the coolant jacket at a first level higher than said combustion chamber; and at least one imperforate baffle member disposed in and extending completely across said coolant jacket, said baffle having its lower end integrally connected with the upper wall of said combustion chamber, said baffle extending upwardly from said combustion chamber wall to a second level intermediate of said first level and said combustion chamber upper wall when said engine is in a generally level state, said baffle member acting as means for inhibiting movement of the liquid coolant within said coolant jacket during changes in attitude of the engine.

2. An internal combustion engine as claimed in claim 1, in which said baffle member has longitudinally opposed ends which are integrally connected to the opposed wall surfaces of said coolant jacket thereby to define in the coolant jacket cells.

3. An internal combustion engine as claimed in claim 2, in which said baffle member extends in a direction substantially parallel with the longitudinal axis of said cylinder head.

4. An internal combustion engine as claimed in claim 3, in which said cylinder head is formed with a pre-combustion chamber, a bore for receiving therein a fuel injection nozzle and a bore for receiving therein a glow plug, said coolant jacket extending in proximity of the pre-combustion chamber.

5. An internal combustion engine as claimed in claim 2, in which said baffle member extends in a direction substantially perpendicular to the longitudinal axis of said cylinder head.

6. An internal combustion engine as claimed in claim 5, in which said baffle member is located at the intermediate portion between the upper portions of the neighbouring two combustion chambers.

7. An internal combustion engine as claimed in claim 5, in which said baffle member is located just above the top of the combustion chamber.

8. An internal combustion engine as claimed in claim 7, further comprising projections which are arranged at the either sides of said baffle member.

9. An internal combustion engine as claimed in claim 8, in which the height of each projection is less than that of said baffle member.

* * * * *